US011674531B2

(12) United States Patent
Heitmann et al.

(10) Patent No.: US 11,674,531 B2
(45) Date of Patent: Jun. 13, 2023

(54) FLUID RETURN APPARATUS FOR A DOUBLE-ACTING CYLINDER AND METHOD FOR OPERATING SUCH A CYLINDER

(71) Applicant: SMC Deutschland GmbH, Egelsbach (DE)

(72) Inventors: Mario Heitmann, Egelsbach (DE); Thorsten Hergenroether, Egelsbach (DE)

(73) Assignee: SMC Deutschland GmbH, Egelsbach (DE)

( * ) Notice: Subject to any disclaimer, the term of this patent is extended or adjusted under 35 U.S.C. 154(b) by 3 days.

(21) Appl. No.: 16/984,376

(22) Filed: Aug. 4, 2020

(65) Prior Publication Data

US 2021/0040946 A1 Feb. 11, 2021

(30) Foreign Application Priority Data

Aug. 8, 2019 (DE) ..... 10 2019 121 433.5

(51) Int. Cl.
*F15B 11/024* (2006.01)
*F15B 11/06* (2006.01)

(52) U.S. Cl.
CPC ..... *F15B 11/024* (2013.01); *F15B 11/06* (2013.01)

(58) Field of Classification Search
CPC .. F04B 5/02; F04B 53/06; F04B 53/10; F04B 53/14; F04B 53/144
See application file for complete search history.

(56) References Cited

U.S. PATENT DOCUMENTS 4,917,001 A 4/1990 Yoshikawa et al.
8,100,046 B2 * 1/2012 Tunkers ..... F15B 11/022 91/395

(Continued)

FOREIGN PATENT DOCUMENTS

DE 18 16 402 A1 7/1970
DE 1816402 A1 * 7/1970 ..... F15B 11/024

(Continued)

OTHER PUBLICATIONS

Author: Dragan et al. Title: Cost effectiveness analysis of pressure regulation method on pneumatic cylinder circuit Date published (mm/yyyy): Jun. 2017 Date accessed: Jun. 23, 2022 Link:https://www.researchgate.net/publication/318948029 (Year: 2017).*

(Continued)

*Primary Examiner* — Charles G Freay
*Assistant Examiner* — Chirag Jariwala
(74) *Attorney, Agent, or Firm* — Oblon, McClelland, Maier & Neustadt, L.L.P.

(57) ABSTRACT

In order to reduce fluid consumption, a fluid return apparatus is provided for a double-acting cylinder having a first fluid connection for supplying fluid to a first cylinder chamber of the cylinder and a second fluid connection for supplying fluid to a second cylinder chamber at a piston rod-side of the cylinder. The fluid return apparatus comprises a first fluid passage providing fluid communication between the first fluid connection and the first cylinder chamber; a rapid venting valve comprising an inlet providing communication with the second fluid connection; an outlet providing communication with the piston-rod-side second cylinder chamber; a vent of the rapid venting valve, connected by a second fluid passage to the first fluid passage; and a non-return fitting in the second fluid passage, which prevents fluid from (Continued)

flowing from the first fluid passage to the rapid venting valve and an auxiliary outlet device.

10 Claims, 3 Drawing Sheets

(56) References Cited

U.S. PATENT DOCUMENTS

| | | | | |
|---|---|---|---|---|
| 2012/0144816 | A1* | 6/2012 | Van Dongen | F15B 11/064 60/484 |
| 2016/0333899 | A1* | 11/2016 | Kondo | F15B 13/0426 |
| 2017/0002845 | A1* | 1/2017 | Lesage | F04B 1/145 |
| 2019/0277310 | A1* | 9/2019 | Takakuwa | F15B 11/024 |
| 2020/0149560 | A1* | 5/2020 | Asahara | F15B 11/024 |
| 2021/0131454 | A1* | 5/2021 | Harimoto | F15B 11/064 |

FOREIGN PATENT DOCUMENTS

| | | | | |
|---|---|---|---|---|
| DE | 26 48 358 | A1 | 4/1978 | |
| DE | 38 34 724 | A1 | 4/1989 | |
| DE | 38 04 081 | A1 | 8/1989 | |
| DE | 11 2010 005 923 | B4 | 8/2013 | |
| DE | 202015003307 | U1 * | 8/2015 | F15B 11/064 |
| DE | 20 2015 003 307 | U1 | 9/2015 | |
| WO | WO 2008/060168 | A1 | 5/2008 | |
| WO | WO 2012/045320 | A1 | 4/2012 | |
| WO | WO 2012/129042 | A1 | 9/2012 | |

OTHER PUBLICATIONS

Extended European Search Report dated Feb. 3, 2021 in corresponding European Patent Application No. 20187879.0 (with English Translation of Category of Cited Documents), 10 pages.

Jan Hepke, "Energetische Untersuchung und Verbesserung der Antriebstechnik pneumatischer Handhabungssysteme", [Energy investigation and improvement of the drive technology of pneumatic handling systems], 1st Edition 2017, ISBN 978-3-8440-5254-1, (relevant pages) 8 pages.

Engineer Student, Rapid Exhaust Valve Operation—Pneumatic Symbols, Engineerstudent co.uk 2009, 1 page, http://www.engineerstudent.co.uk/rapid_exhaust_valve_symbols.html.

* cited by examiner

FLUID RETURN APPARATUS FOR A DOUBLE-ACTING CYLINDER AND METHOD FOR OPERATING SUCH A CYLINDER

The invention relates to a fluid return apparatus for a double-acting cylinder. The invention further relates to a device for operating a double-acting cylinder and a method for operating a double-acting cylinder.

In double-acting pneumatic cylinders, an interior space of the cylinder is divided by a piston into a first cylinder chamber facing away from a piston rod and into a second cylinder chamber at a piston rod-side. A piston rod is attached to the piston, which extends outwards through the second cylinder chamber. The piston—or more precisely the piston rod—is extended by filling compressed air into the first cylinder chamber. As a result, a volume of the first cylinder chamber increases and at the same time a volume of the second cylinder chamber decreases whilst the piston moves to one side of the second cylinder chamber.

It has already been proposed to connect rapid venting valves to cylinder chambers of pneumatic cylinders so that the fluid can escape more rapidly from the respective cylinder chamber when its volume is reduced, for example, in DE 26 48 358 A1 and DE 38 04 081 A1. In this case, the air from the relevant cylinder chamber is removed outwards into the environment.

The efficiency of pneumatic cylinders can be improved with energy saving circuits. Such energy-saving circuits are known, for example, from the book "Energetische Untersuchung and Verbesserung der Antriebstechnik pneumatischer Handhabungssysteme" [Energy investigation and improvement of the drive technology of pneumatic handling systems], Author Jan Hepke, 1st Edition 2017, ISBN 978-3-8440-5254-1. However, known solutions have the disadvantage that they require many components or additional control functions. As a result, in particular retrofittings in existing installations can only be achieved with considerable effort.

In addition, by using known energy-saving circuits, in some cases a retraction force or an extension force of the double-acting pneumatic cylinder is reduced. In addition, depending on the operating mode, a motion speed of the piston is at least reduced in one of these directions of movement.

The object of the present invention is to provide an apparatus and a method by means of which a fluid consumption during operation of a double-acting cylinder is reduced.

The object is achieved by a fluid return apparatus for a double-acting cylinder having the features of Patent claim 1.

The object is achieved by a fluid return apparatus for a double-acting pneumatic cylinder having a fluid return apparatus comprising a first fluid supply for supplying fluid to a first cylinder chamber of the cylinder facing away from the piston rod and a second fluid supply for supplying fluid to a second cylinder chamber of the cylinder at a piston-rod-side.

a first fluid passage for producing a fluid communication between the first fluid connection and the first cylinder chamber;

a rapid venting valve comprising an inlet for communication with the second fluid connection, an outlet for communication with the second cylinder chamber at the piston-rod-side, and a vent, which is connected by a second fluid passage to the first fluid passage; and a check valve in the second fluid passage which prevents fluid flowing from the first fluid passage to the rapid venting valve.

The first fluid passage can, for example, be configured as a line, as a pipe, as a hose or as a channel which is provided in a base body.

If the fluid return apparatus is connected to the double-acting cylinder, the first cylinder chamber can be supplied with fluid via the first fluid passage in order to extend the cylinder (more precisely: a piston rod of the double-acting cylinder). In this case, fluid flows from the first fluid connection through the first fluid passage into the first cylinder chamber. The first fluid connection is therefore used as a first fluid supply.

If the volume of the second cylinder chamber decreases during extension of the cylinder, fluid flows from the second cylinder chamber to the outlet of the rapid venting valve and into the rapid venting valve. The rapid venting valve prevents the fluid from passing from the outlet of the rapid venting valve to the inlet of the rapid venting valve and flowing out from the inlet. Instead, it enables the fluid to flow out from the second cylinder chamber in this state, through the vent of the rapid venting valve further into the second fluid passage.

The rapid venting valve therefore acts similarly to a check valve in relation to a fluid connection between its inlet (and the associated second fluid connection) and its outlet (and the associated second cylinder chamber).

As already mentioned, a check valve is provided in the second fluid passage. If a fluid pressure in the second fluid passage on a side of the vent of the rapid venting valve (upstream side) is higher than the fluid pressure in the first fluid passage, fluid flows from the vent of the rapid venting valve through the second fluid passage and the non-return fitting therein into the first fluid passage and finally enters into the first cylinder chamber. As a result, during extension of the cylinder, at least a part of the fluid which is displaced by a piston of the double-acting cylinder from the second cylinder chamber is returned into the first fluid passage and ultimately into the first cylinder chamber. In other words, the rapid venting valve and the second fluid passage are used to return fluid from the second cylinder chamber into the first cylinder chamber.

The double-acting cylinder is a double-acting cylinder with a one-sided piston rod. An interior space of the cylinder is divided by the piston into the first cylinder chamber facing away from the piston rod and the piston-rod-side second cylinder chamber. The piston rod extends through the piston-rod-side second cylinder chamber of the cylinder. Consequently, a second effective cross-sectional area of the piston on one side of the second cylinder chamber is smaller than an effective first cross-sectional area of the piston on one side of the first cylinder chamber. As a result, it is possible that the fluid pressure in the second cylinder chamber exceeds the fluid pressure in the first cylinder chamber when fluid, for example, compressed air is supplied to the first cylinder chamber from outside (via the first fluid connection and the first fluid passage). As a result of this pressure difference, it is possible for fluid to be returned from the second cylinder chamber into the first cylinder chamber in the manner described and energetically advantageous.

On account of the return of fluid, substantially less fluid needs to be additionally supplied via the first fluid connection in order to extend the double-acting cylinder. For example, 24% compressed air is saved with the fluid return apparatus during a complete cycle of the cylinder (retraction and extension). Thus, the efficiency of the connected cylinder is improved considerably and the operation of the double-acting cylinder is more cost-effective, energetically more favourable and more environmentally friendly. Ultimately, in particular $CO_2$ emissions can be reduced.

When the fluid return apparatus is connected to the double-acting cylinder, on the other hand the second cylinder chamber can be supplied with fluid via the rapid venting valve. To this end, fluid flows from the second fluid connection into the inlet of the rapid venting valve and via the outlet of the rapid venting valve further into the second cylinder chamber. The second fluid connection therefore serves as a second fluid supply during retraction. The piston is moved so that the volume of the second cylinder chamber is increased and the volume of the first cylinder chamber is reduced. Fluid in the first cylinder chamber can escape through the first fluid passage and further via the first fluid connection. Alternatively or additionally the fluid can escape in a different way from the first cylinder chamber when the cylinder (or its piston rod) is retracted.

During retraction the cylinder can be operated as if it were connected conventionally without the fluid return apparatus.

An essential advantage of the rapid venting valve consists in that it safely and reliably closes its inlet for the fluid return and thus ensures the back flow of fluid from its outlet to its vent. On the other hand, it opens its inlet and closes its vent when fluid at elevated pressure is supplied from the second fluid connection at its inlet. As a result, fluid can be reliably supplied to the second cylinder chamber to retrain the cylinder. At the same time, in this state none of the fluid supplied by the second fluid connection enters in an undesired manner into the second fluid passage since the vent is closed during retraction.

An advantage of the fluid return apparatus is its simple structure. It is cost-effective and space-saving. In addition, it can be integrated simply, cost-effectively and rapidly. It can be used on any double-acting pneumatic cylinder with a one-sided piston rod.

The fluid return apparatus according to the invention is further characterized in that its extension force during extension of the cylinder using the fluid return apparatus remains at least substantially the same. Preferably, the extension force of the double-acting cylinder using the fluid return apparatus is reduced by less than 10%, particularly preferably by less than 5% and extremely preferably by less than 2%. This in particular includes the fact that the extension force of the double-acting cylinder using the fluid return apparatus is the same or even greater than that without it.

Alternatively or additionally, the fluid return apparatus according to the invention is characterized in that a retraction force during retraction of the cylinder using the fluid return apparatus remains at least substantially the same. Preferably the retraction force of the double-acting cylinder using the fluid return apparatus is reduced by less than 10%, particularly preferably by less than 5% and completely preferably by less than 2%.

As a comparison in this sense, in each case an operation of the same cylinder under the same conditions without the fluid return apparatus is used, wherein the first cylinder chamber is connected in a conventional manner directly to the first fluid connection and the second cylinder chamber is connected directly to the second fluid connection.

The fluid return apparatus can therefore be used safely for known installations without there being any need to fear a significant reduction in its capacity. To this end the fluid return apparatus is simply connected in the manner described between the first fluid connection and the first cylinder chamber and the second fluid connection and the second cylinder chamber.

Preferably the fluid is air. In particular, the first fluid connection can serve as a first compressed air supply. Alternatively or additionally the second fluid connection can serve as a second compressed air supply. Air is readily and cheaply available. It can be provided in a known manner simply, cost-effectively, rapidly and in large quantity.

In a further advantageous embodiment the non-return fitting comprises a non-return valve. Particularly preferably the non-return fitting is a check valve. This contributes to the simple, compact and cost-effective structure.

In a further development of the invention, the inlet, the outlet and/or the vent of the rapid venting valve are each configured as a fluid connection, particularly preferably as a compressed air connection, completely preferably as a compressed air coupling. This enables a simple and safe, optionally also detachable connection of the rapid venting valve.

Preferably the fluid return apparatus comprises fluid connections for connection to the first cylinder chamber, the second cylinder chamber, the first fluid connection and/or the second fluid connection, particularly preferably compressed air connections, completely preferably compressed air couplings. This ensures an easy handling and installation of the fluid return apparatus. In particular, it can be retrofitted particularly rapidly and easily as a result.

In a further development of the invention, a flow cross-section of the second fluid passage is approximately as large as a flow cross-section of the first fluid passage. In a particularly preferred embodiment of the invention, the flow cross-section of the second fluid passage is a maximum of 30% larger or smaller than the flow cross-section of the first fluid passage, completely preferably a maximum of 20%, extraordinarily preferably a maximum of 10%. As a result, the energy benefit of the return of fluid from the second cylinder chamber into the first fluid passage and into the first cylinder chamber is appreciably particularly great. When the flow cross-section of the second fluid passage becomes larger, a volume of the second fluid passage also increases and the pressure therein decreases. This adversely affects the energy gain due to the return. When the flow cross-section of the second fluid passage becomes smaller, this tends to result in a higher pressure therein but the volume of the fluid returned into the first cylinder chamber decreases or is even not sufficient. Therefore, it is advantageous if the flow cross-section of the second fluid passage and the first fluid passage are approximately the same.

Alternatively or additionally the flow cross=section of the second fluid passage is a maximum of 30% larger or smaller than

- a flow cross-section of the first fluid connection,
- a flow cross-section of the second fluid connection,
- a flow cross-section of a fluid communication between the outlet of the rapid venting valve and the second cylinder chamber and/or
- than a flow cross-section of a fluid communication between the first fluid passage and the first cylinder chamber (if provided), completely preferably a maximum of 20%, extraordinarily preferably a maximum of 10%. This dimensioning of the second fluid passage ensures a particularly high energy efficiency of the return.

The fluid return apparatus comprises an auxiliary outlet device. The auxiliary outlet device is adapted to counteract a residual excess pressure in the second cylinder chamber during extension of the cylinder. It can, for example, be adapted to let out fluid into the surroundings or into a collecting tank.

Preferably the auxiliary outlet device is adapted so that fluid can then at least flow from the fluid return apparatus from the second cylinder chamber when the non-return fitting is closed and the cylinder extends at the same time.

As mentioned, the non-return fitting prevents fluid from flowing from the first fluid passage via the second fluid passage to the rapid venting valve. Consequently, no fluid can flow out from the first fluid passage through the auxiliary outlet device. For example, the non-return fitting executed as a check valve can close during extension of the cylinder if the fluid pressure in the first fluid passage is the same. At the same time however, during extension of the cylinder the rapid venting valve prevents fluid flowing into the outlet from flowing out through the inlet. Consequently, it is possible that a residual excess pressure compared with a reference pressure, for example, an ambient pressure remains in the second cylinder chamber. The residual excess pressure can slow or even hinder the complete extension of the cylinder. As mentioned above, the auxiliary outlet device is adapted to counteract the residual excess pressure in the second cylinder chamber during extension of the cylinder (that is to reduce or even prevent such a residual excess pressure).

Preferably the auxiliary outlet device is connected parallel to the non-return fitting to the vent of the rapid venting valve. It can in particular be connected between the vent and the non-return fitting to the second fluid passage. This enables a simple and cost-effective integration.

The auxiliary outlet device can, for example, comprise an outlet opening, a throttle and/or a controllable valve.

In a simple case, the auxiliary outlet device is, for example, an outlet opening, whose flow cross-section is substantially smaller than the flow cross-section of the second fluid passage. Particularly preferably the flow cross-section of the outlet opening is a maximum of 10% of the flow cross-section of the second fluid passage, completely preferably a maximum of 3%, extraordinarily preferably a maximum of 1%.

If a pressure difference of the fluid pressure in the first fluid passage minus the fluid pressure at the vent of the rapid venting valve is large, for example, in the middle of the extension of the cylinder, the fluid displaced from the second cylinder chamber is allowed through by the non-return fitting and on account of the larger flow diameter flows primarily through the second fluid passage into the first fluid passage. On account of the smaller flow diameter of the outlet opening, however, only a small proportion of the fluid displaced from the second cylinder chamber is let out through the outlet opening. If during approach of the piston to a maximally extended position, the pressure difference disappears and the non-return fitting closes, a limited volume flow of fluid will still escape from the second cylinder chamber and be removed outwards through the outlet opening until the residual excess pressure disappears. As a result, the residual excess pressure decreases in a controlled manner to the ambient pressure and the cylinder can be completely extended at least substantially unhindered.

Preferably the auxiliary outlet device limits an outlet volume flow of the fluid flows out from the auxiliary outlet device. This can be accomplished, for example, by a limitation of the area of the outlet opening. Consequently, the outlet losses of the fluid are reduced.

Alternatively or additionally, the auxiliary outlet device comprises an outlet mechanism which is adapted to close a fluid outlet into the surroundings when the fluid pressure in the first fluid passage is higher than the fluid pressure at the vent of the rapid venting valve by at least a specified amount and to open it otherwise. The specified amount can be an absolute pressure difference and/or a pressure ratio. In particular, the specified amount can correspond to a pressure difference of zero. As a result, during extension of the cylinder no fluid is lost at all as long as fluid is returned. However, such a solution is more complex than the small outlet opening described above.

Particularly preferably the auxiliary outlet device is configured integrally with the rapid venting valve, in particular with its vent, with the second fluid passage and/or with the non-return fitting. This saves installation space, simplifies production and reduces the costs. However, the auxiliary outlet device can also be formed by one or several separate components.

In a preferred embodiment of the invention, the fluid return apparatus is configured as a separate unit for connection to the double-acting cylinder. As a result, the fluid return apparatus can be produced particularly easily. In addition, it can be retrofitted easily, cost-effectively, rapidly and problem-free in existing installations without the cylinder or a control valve for the cylinder itself needing to be exchanged.

A further aspect of the invention relates to a combination of the fluid return apparatus with the double-acting cylinder.

In particular, the invention also relates to a double-acting cylinder, comprising a fluid return apparatus according to one of the described embodiments, wherein the first fluid passage is in fluid communication with a first cylinder chamber of the cylinder facing away from the piston rod and wherein the outlet of the rapid venting valve is in fluid communication with a piston-rod-side second cylinder chamber of the cylinder.

The first effective cross-sectional area of the piston facing away from the piston rod (on the side of the first cylinder chamber) is larger than the piston-rod-side second effective cross-sectional area of the piston (on the side of the second cylinder chamber).

In other words, the second effective cross-sectional area is smaller than the first effective cross-sectional area. Preferably a size of the second effective cross-sectional area is 40% to 95% of the first effective cross-sectional area, particularly preferably 70% to 90% and particularly preferably 80% to 90%. As a result, during retraction on the one hand a sufficiently high fluid pressure for the fluid return is ensured in the second cylinder chamber, on the other hand the retraction force compared with the extension force is still sufficiently high.

Preferably the double-acting cylinder is a double-acting pneumatic cylinder with precisely one one-sided piston rod. However, it is also possible that several piston rods (i.e. at least two piston rods) are attached to the piston. For example, two piston rods can be attached to the piston and extend outwards parallel to one another through the first cylinder chamber. Several double-acting cylinders can also be provided.

In a further development of the invention, the fluid return apparatus and the cylinder are arranged jointly in a housing and/or formed jointly in a base body. As a result, the system comprising fluid return apparatus and double-acting cylinder is particularly compact and cost-effective. As a result of the absence of intermediate connections, in particular detachable intermediate connections, possible source of faults are additionally avoided. In particular, the fluid return apparatus can be integrated in the double-acting cylinder.

In another preferred embodiment of the invention, the fluid return apparatus is configured as a separate unit. The double-acting cylinder and the fluid return apparatus can have a coupling device for detachable connection between the double-acting cylinder and the actual fluid return apparatus. As a result, the two elements can be rapidly and easily separated from one another or connected to one another, maintained and if necessary rapidly exchanged.

The fluid return apparatus and/or the cylinder are preferably designed for a fluid pressure or operating pressure of at least 0.15 MPa, particularly preferably in the range between 0.3 and 1.6 MPa, for example 0.6 MPa.

According to a further aspect, the invention further comprises an apparatus for operating the double-acting cylinder, a fluid return apparatus according to one of the previously described embodiments as well as in addition a control valve with a fluid inlet and at least one fluid outlet which can adopt at least two states. In a first state the control valve connects the fluid inlet to the first fluid passage of the fluid return apparatus and in a second state the control valve connects the fluid inlet to the inlet of the rapid venting valve of the fluid return apparatus and connects the first fluid passage of the fluid return apparatus to the at least one fluid outlet.

The fluid inlet is adapted for communication with a fluid pressure source. The at least one fluid outlet is provided for outlet of fluid from the apparatus.

In the first state the inlet of the rapid venting valve is not connected to the fluid inlet. Therefore in the first state no fluid is supplied from the fluid inlet to the rapid venting valve and the second cylinder chamber. In the second state the first fluid passage is not connected to the fluid inlet.

In a further development of the apparatus the fluid inlet of the control valve is connected to a fluid pressure source. As a result, the fluid inlet of the control valve is supplied with fluid with higher pressure. Particularly preferably the fluid pressure source provides compressed air. The fluid pressure provided by the fluid pressure source is preferably at least 0.15 MPa, particularly preferably it lies in a range between 0.3 and 1.6 MPa, for example, at 0.6 MPa.

Alternatively or additionally, a silencer is connected to the at least one fluid outlet of the control valve. As a result, noise of fluid (for example, compressed air) which flows from the at least one fluid outlet is muffled.

In particular, the apparatus can comprise the silencer.

Particularly, preferably the control valve is a 4/3 way valve. Particularly preferably the 4/3 way valve is closed in a middle position between the first state and the second state.

In another particularly preferred embodiment of the invention, the control valve is a 5/2 way valve. This solution is even more cost-effective. In particular in this case, the control valve can have a second fluid outlet in addition to the at least one fluid outlet.

In a further development of the invention, in the first state the control valve additionally connects the inlet of the rapid venting valve to a fluid outlet of the control valve. In this case, for example, this can comprise the at least one fluid outlet or a further fluid outlet. It is thereby avoided that a higher fluid pressure could remain applied to the inlet of the rapid venting valve when the control valve is switched into the first state. A possible fluid flow from the inlet of the rapid venting valve to its outlet is thus reliably eliminated during the first state.

The control valve and the fluid return apparatus can be provided as a unit. For example, both can be accommodated in a common housing and/or formed in a common base body. In particular, the control valve can be integrated in the fluid return apparatus. In this case, the fluid return apparatus comprising the control valve can be provided as a separate unit for connection to the double-acting cylinder.

In a further embodiment, the control valve, the fluid return apparatus and the double-acting cylinder are provided as a unit. In particular, the control valve and the fluid return apparatus can both be integrated in the double-acting cylinder.

The aforesaid object is further achieved by a method for operating a double-acting pneumatic cylinder in which at least a part of the fluid in the second cylinder chamber is returned to the first cylinder chamber via the vent of the rapid venting valve when a volume of the second cylinder chamber is reduced.

Preferably a fluid return apparatus according to one of the previously described embodiments is used for the method.

The embodiments and advantages described for the fluid return apparatus, the combination of the fluid return apparatus with the double-acting cylinder, the apparatus for operating the double-acting cylinder and for the method also apply accordingly to the respectively other objects.

The invention is explained hereinafter with reference to exemplary embodiments and with reference to the figures. In this case, all the described and/or pictorially depicted features by themselves or in any combination form the subject matter of the invention, also independently of their combination in the claims or their back references.

In the figures schematically:

Figure 1:
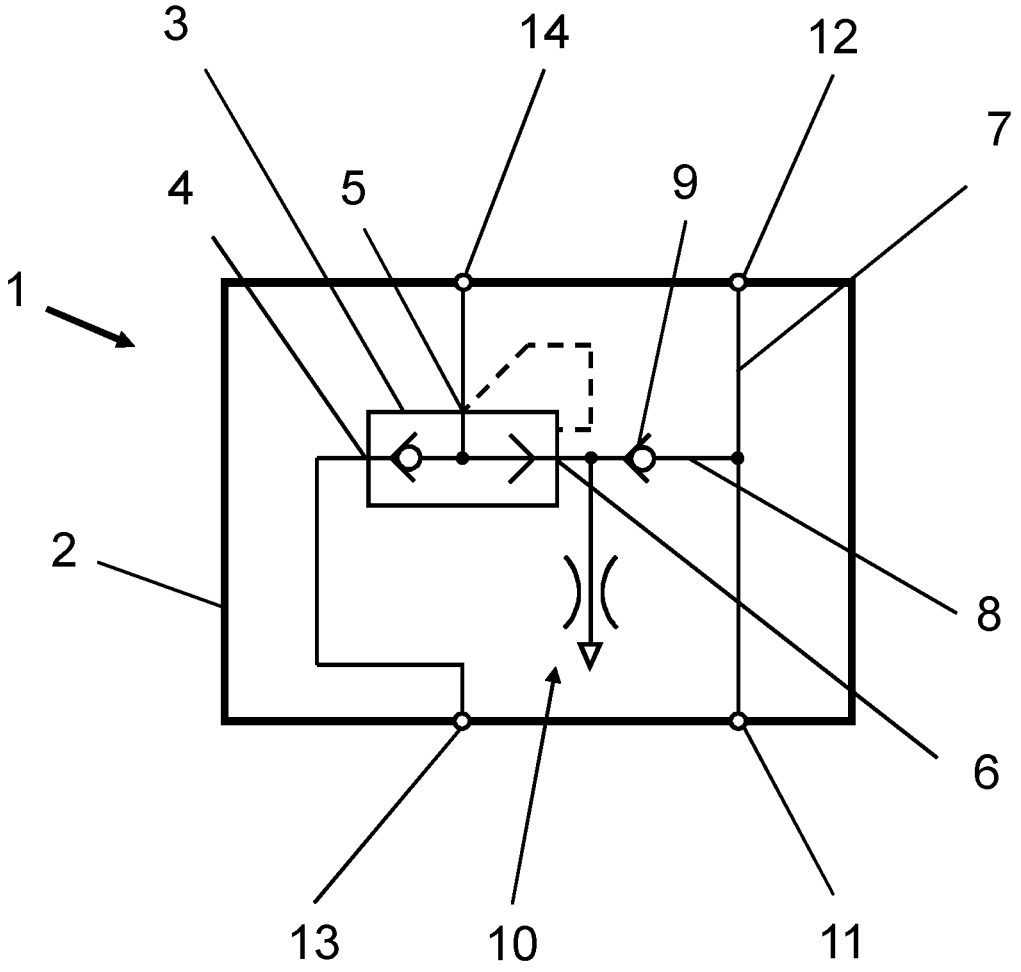
FIG. 1 shows an embodiment of a fluid return apparatus according to the invention.

The embodiment of a fluid return apparatus 1 according to the invention shown schematically in FIG. 1 comprises a housing 2, a rapid venting valve 3, a first fluid passage 7, a second fluid passage 8 with a non-return fitting which is configured as a check valve 9, an auxiliary outlet device 10 and four fluid connections 11, 12, 13, 14. The four fluid connections 11, 12, 13, 14 are configured as compressed air connections in the embodiment. The second fluid passage 8 produces a fluid communication from a vent 6 of the rapid venting valve 3 to the first fluid passage 7. The check valve 9 in the second fluid passage 8 prevents fluid from being able to flow from the first fluid passage 7 through the second fluid passage 8 in the direction of the vent 6. The check valve 9 therefore predefines a flow direction for fluid in the second fluid passage 8, wherein the vent 6 opens into an upstream end of the second fluid passage 8 and a downstream end of the second fluid passage 8 opens into the first fluid passage 7.

Figure 2:
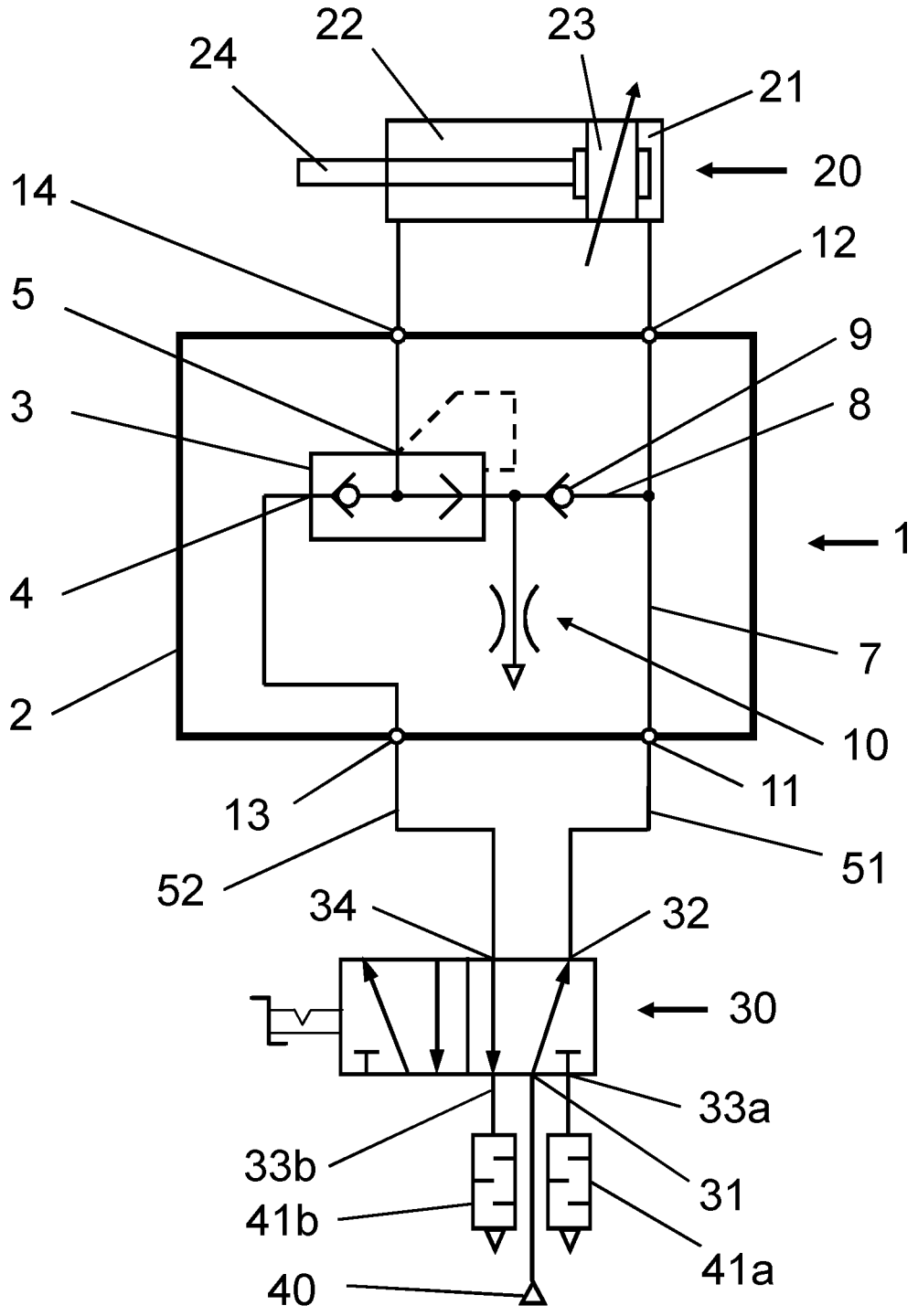
FIG. 2 shows an apparatus for operating a double-acting cylinder which comprises the fluid return apparatus from FIG. 1 and a control valve.

In the embodiment shown in FIG. 1 the fluid return apparatus 1 is configured as a separate unit with the housing 2. The unit is adapted to be connected to a double-acting cylinder 20, as shown in FIG. 2. In this case, compressed air is used as fluid.

A first cylinder-side fluid connection 12 is used for connection of a first cylinder chamber 21 of the double-acting cylinder 20 (not shown in FIG. 1, see FIG. 2) to the fluid return apparatus 1. A second cylinder-side fluid connection 14 is used for connection of a second cylinder chamber 22 of the same cylinder 20 to the fluid return apparatus 1.

A first fluid connection 11 facing away from the cylinder is used for connection to a first fluid connection via which fluid can be provided for feeding into the first cylinder chamber 21. A second fluid connection 13 facing away from the cylinder is used for connection to a second fluid connection via which fluid can be provided for feeding into the second cylinder chamber 22.

The first fluid passage 7 produces a direct fluid communication between the first fluid connection 11 facing away from the cylinder and the first cylinder-side fluid connection 12.

The rapid venting valve 3 has an inlet 4, an outlet 5 and the vent 6.

The inlet 4 is in direct fluid communication with the second fluid connection 13 facing away from the cylinder. More generally it is provided that the second fluid communication can be connected to the inlet 4 and when the fluid return apparatus 1 is used as provided, it is connected accordingly.

The outlet 5 is in direct fluid communication with the second cylinder-side fluid connection 14. More generally it is provided that the second fluid communication can be connected to the piston-rod-side second cylinder chamber 22 and when the fluid return apparatus 1 is used as provided, it is connected accordingly.

As mentioned above, the vent 6 is adjoined to the second fluid passage 8.

The rapid venting valve 3 affords a rebound function in relation to a fluid communication from the inlet 4 to the outlet 5. Fluid can (at least substantially unhindered) flow out from the inlet 4 to the outlet 5 and flow out from the outlet 5.

On the other hand, the rapid venting valve 3 prevents fluid from being able to flow out from the outlet 5 through the inlet 4. When fluid flows in through the outlet 5 into the rapid venting valve 3, it flows out through the vent 6 from the rapid venting valve 3.

Preferably individual ones or all the fluid connections 11, 12, 13, 14 are executed as compressed air couplings in order to enable a simple and secure connection of the fluid return apparatus 1. Accordingly, the fluid return apparatus 1 can be easily removed again.

The mode of operation and use of the fluid return apparatus 1 will now be explained in more detail with reference to FIG. 2.

The same reference numbers are used for the same elements in the different figures and the corresponding explanations apply likewise for the different figures.

In FIG. 2 the double-acting cylinder 20 and a control valve 30 are connected to the fluid return apparatus 1 from FIG. 1.

The cylinder 20 shown in FIG. 2 comprises a double-acting pneumatic cylinder with a one-sided piston rod 24. Compressed air is used as fluid for movement of the piston. An interior space of the cylinder 20 is divided by a piston 23 into a first cylinder chamber 21 and a second cylinder chamber 22. The piston 23 is accommodated in the interior space of the cylinder 20 so that it can be moved along a longitudinal direction of the cylinder 20. A piston rod 24 is attached to the piston 23. The precisely one piston rod 24 of the cylinder 20 extends from the piston 23 along the longitudinal direction of the cylinder 20 through the second cylinder chamber 22 and projects from the interior space of the cylinder 20. The piston rod 24 thus transmits the movements of the piston 23 outwards.

Consequently external objects can be moved by means of the piston rod 24 through the cylinder 20.

In FIG. 2 the first cylinder chamber 21 facing away from the piston rod as provided is connected to the first cylinder-side fluid connection 12 of the fluid return apparatus 1 and the piston-rod-side second cylinder chamber 22 is connected as provided to the second cylinder-side fluid connection 14 of the fluid return apparatus 1. Consequently the first cylinder chamber 21 is in direct fluid communication with the first fluid passage 7 and the second cylinder chamber 22 is in direct fluid communication with the outlet 5 of the rapid venting valve 3.

In this embodiment the control valve 30 is a 5/2 way control valve for compressed air. A second fluid connection 32 (compressed air connection) of the control valve 30 is connected via a first fluid communication 51 to the first fluid connection 11 of the fluid return apparatus 1 facing away from the cylinder. A fourth fluid connection 34 of the control valve 30 is connected via a second fluid communication 52 to the second fluid connection 13 of the fluid return apparatus 1 facing away from the cylinder.

As will become apparent, the first fluid communication 51 serves in particular as the first fluid connection for supplying fluid (more precisely compressed air) to the first cylinder chamber 21 of the cylinder 20 facing away from the piston rod. The second fluid communication 52 serves in particular as the second fluid connection for supplying fluid (more precisely compressed air) to the piston-rod-side second cylinder chamber 22 of the cylinder 20.

A first compressed air connection of the control valve 30 serves as a fluid inlet 31 and is in fluid communication with a fluid supply source 40 which in the present embodiment is configured as a compressed air source. A third fluid connection of the control valve 30 serves as a first fluid outlet 33*a* of the control valve 30. A first silencer 41*a* is connected to the first fluid outlet 33*a* through which compressed air can be exhaused into the atmosphere.

A fifth fluid connection of the control valve 30 serves as a second fluid outlet 33*b* of the control valve 30. A second silencer 41*b* is connected to the second fluid outlet 33*b* through which compressed air can be exhausted into the atmosphere.

The control valve 30 can adopt two states.

In a first state shown in FIG. 2, for extension of the cylinder 20 the control valve 30 connects the fluid inlet 31 to the second compressed air connection 32 and accordingly (via the first fluid communication 51 and the first compressed air connection 11 facing away from the cylinder) to the first fluid passage 7.

In a second state not shown, for retraction of the cylinder 20 the control valve 30 connects the fluid inlet 31 to the fourth compressed air connection 34 and accordingly (via the second fluid communication 52 and the second compressed air connection 13 facing away from the cylinder) to the inlet 4 of the rapid venting valve 3. At the same time, in its second state the control valve connects its second fluid connection 32 (and therefore via the first fluid communication 51 and the first fluid connection 11 facing away from the cylinder the first fluid passage 7) to its first fluid outlet 33*a*.

During extension of the double-acting cylinder 20 a residual excess pressure could occur in the second cylinder chamber 22 when the check valve 9 closes before the cylinder 20 is completely extended. This residual excess pressure could hinder or at least slow down a complete extension of the piston rod 24. Between the vent 6 and the check valve 9 the auxiliary outlet device 10 is therefore connected to the second fluid passage 8. The auxiliary outlet device 10 is consequently connected parallel to the check valve 9 to the vent 6. In the present exemplary embodiment the auxiliary outlet device 10 consists of a small outlet opening. The outlet opening can be a small bore in the vent 6 itself or in the second fluid passage 8 between the vent 6 and the check valve 9. Through this outlet opening fluid (compressed air) can flow out into the surroundings. A flow cross-section of the outlet opening is substantially smaller than the flow cross-section of the second fluid passage 8. Therefore only a negligibly small proportion of the air displaced from the second cylinder chamber 22 during extension flows outwards through the outlet opening as long as the check valve 9 is open. However, the outlet opening is sufficient to reduce the residual excess pressure rapidly and in a controlled manner after closing the check valve 9. Consequently the auxiliary outlet device 10 counteracts the residual excess pressure. It thereby prevents or reduces a hindering of the extension of the cylinder 20 by such a residual excess pressure.

Figure 3:
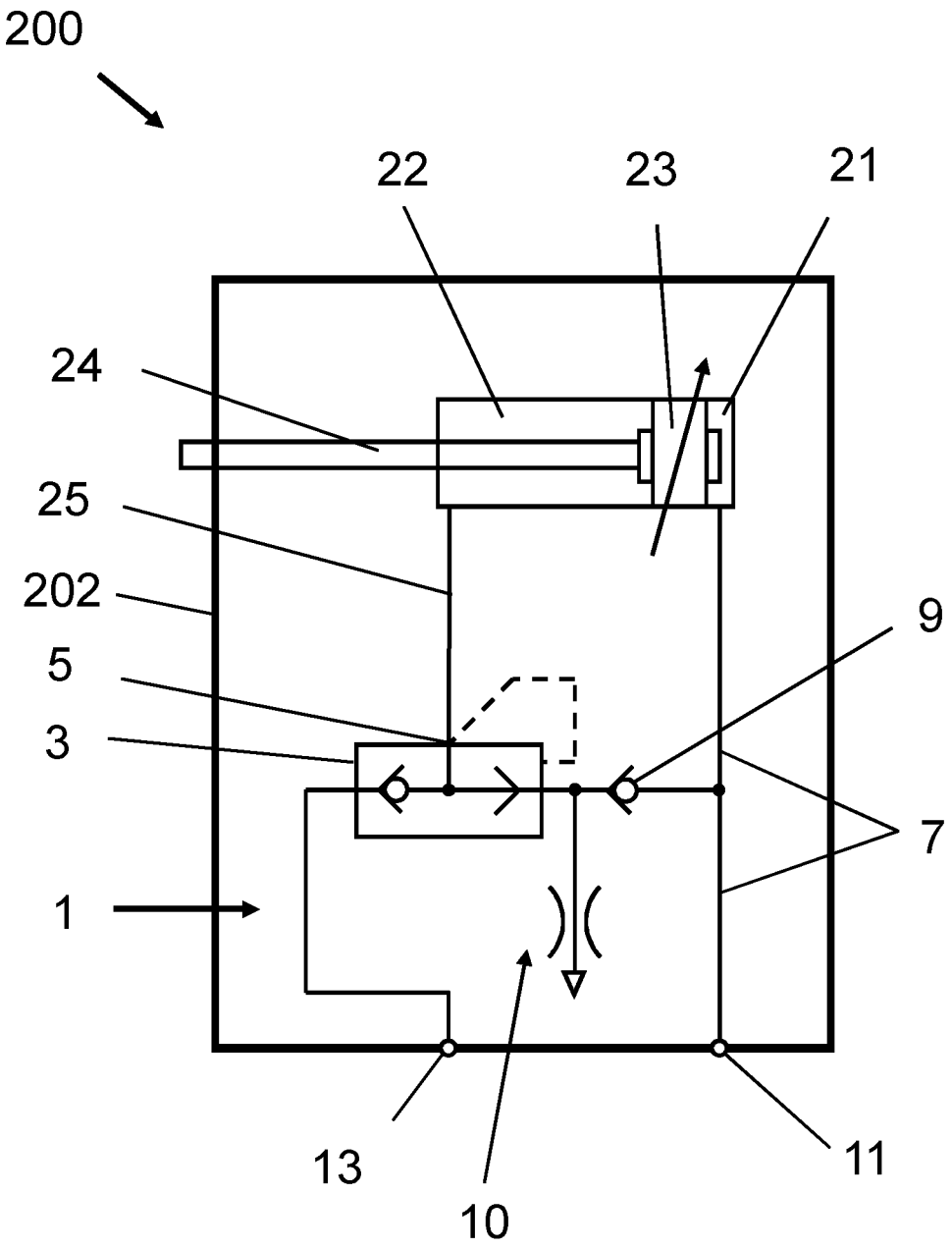
FIG. 3 shows a combination of a fluid return apparatus with a double-acting cylinder according to the invention, wherein the fluid return apparatus is integrated in the cylinder.

FIG. 3 shows schematically a further embodiment according to the invention in which the fluid return apparatus 1 from FIGS. 1 and 2 is directly integrated in a cylinder 200. The first cylinder chamber 21, the second cylinder chamber 22, the piston 23 and the fluid return apparatus 1 are here formed jointly in a base body 202 of the cylinder 200. Accordingly, the fluid return apparatus 1 is here not configured as a separate unit.

As a result, the entire structure is more compact, easier to handle and more cost-effective. Here the first fluid passage 7 is connected directly to the first cylinder chamber 21. Furthermore, the outlet 4 of the rapid venting valve 3 is connected directly to the second cylinder chamber 22 via a third fluid passage 25. Otherwise, the structure and operating mode correspond to the fluid return apparatus 1 from FIG. 1 and FIG. 2 and the cylinder 20 from FIG. 2.

With the proposed fluid return apparatus 1 the compressed air consumption for the double-acting cylinder 20, 200 is reduced appreciably. At the same time, the retraction and extension force of the cylinder 20, 200 is fully maintained. At the same time, the time required for retraction is almost unchanged and the time required for extension is only slightly increased.

REFERENCE LIST

1 Fluid return apparatus
2 Housing
3 Rapid venting valve
4 Inlet
5 Outlet
6 Vent
7 First fluid passage
8 Second fluid passage
9 check valve
10 Auxiliary outlet device
11, 12, 13, 14 Fluid connection
20, 200 Cylinder
21 First cylinder chamber
22 Second cylinder chamber
23 Piston
24 Piston rod
25 Third fluid passage
30 Control valve
31 Fluid inlet
32, 34 Fluid connection
33*a*, 33*b* Fluid outlet
40 Fluid pressure source
41*a*, 41*b* Silencer
51, 52 Fluid communication
202 Base body

The invention claimed is:

1. A fluid return apparatus for a double-acting pneumatic cylinder having a first fluid connection for supplying fluid to a first cylinder chamber of the double-acting pneumatic cylinder to extend a piston rod of a piston in the cylinder, the first cylinder chamber facing away from the piston rod, and a second fluid connection for supplying fluid to a second cylinder chamber at a piston rod-side of the double-acting pneumatic cylinder to retract the piston, wherein the fluid return apparatus comprises:

a first fluid passage providing fluid communication between the first fluid connection and the first cylinder chamber;

a rapid venting valve comprising an inlet, an outlet and a vent, wherein the inlet of the rapid venting valve provides communication with the second fluid connection;

wherein the outlet of the rapid venting valve provides communication with the second cylinder chamber at the piston rod-side of the double-acting pneumatic cylinder, and wherein the vent of the rapid venting valve is connected by a second fluid passage to the first fluid passage; and a non-return fitting in the second fluid passage, wherein the non-return fitting prevents fluid from flowing from the first fluid passage to the rapid venting valve and an auxiliary outlet device, wherein the second fluid passage directly returns the fluid from the second cylinder chamber to the first cylinder chamber, when expanding the first fluid chamber to extend the piston rod, and when the fluid pressure in the second cylinder chamber is greater than the fluid pressure in the expanding the first cylinder chamber.

2. The fluid return apparatus according to claim 1, wherein the non-return fitting comprises a check valve.

3. The fluid return apparatus according to claim 1, wherein the auxiliary outlet device and the non-return fitting are connected to the vent of the rapid venting valve in parallel with one another.

4. The fluid return apparatus according to claim 1, wherein the auxiliary outlet device is adapted to limit an outlet volume flow of fluid flowing out from the auxiliary outlet device.

5. The fluid return apparatus according to claim 1, wherein the fluid return apparatus is a unit separate from the double-acting pneumatic cylinder.

6. A double-acting pneumatic cylinder having a first fluid connection for supplying fluid to a first cylinder chamber of the double-acting pneumatic cylinder, the first cylinder chamber facing away from a piston rod of a piston in the cylinder, to extend the piston rod, and a second fluid connection for supplying fluid to a second cylinder chamber at a piston rod-side of the double-acting pneumatic cylinder, wherein the double acting pneumatic cylinder has a fluid return apparatus comprising:

a first fluid passage providing fluid communication between the first fluid connection and the first cylinder chamber;

a rapid venting valve comprising an inlet, an outlet and a vent, wherein the inlet of the rapid venting valve provides communication with the second fluid connection;

wherein the outlet of the rapid venting valve provides communication with the second cylinder chamber at the piston rod-side of the double-acting pneumatic cylinder, and wherein the vent of the rapid venting valve is connected by a second fluid passage to the first fluid passage; and a non-return fitting in the second fluid passage, wherein the non-return fitting prevents fluid from flowing from the first fluid passage to the rapid venting valve and an auxiliary outlet device, wherein the first fluid passage is in fluid communication with the first cylinder chamber of the double-acting pneumatic cylinder facing away from the piston rod, and wherein the outlet of the rapid venting valve is in fluid communication with the second cylinder chamber at the piston rod-side of the double-acting pneumatic cylinder, wherein the second fluid passage directly returns the fluid from the second cylinder chamber to the first cylinder chamber, when expanding the first fluid chamber to extend the piston rod, and when the fluid pressure in the second cylinder chamber is greater than the fluid pressure in the expanding the first cylinder chamber.

7. The double-acting pneumatic cylinder according to claim 6, wherein the fluid return apparatus is integrated in the double-acting pneumatic cylinder.

8. A method of operating the double-acting pneumatic cylinder according to claim 6, including a step of returning at least a part of the fluid in the second cylinder chamber to the first cylinder chamber via the vent of the rapid venting valve when a volume of the second cylinder chamber is reduced.

9. An apparatus for operating a double-acting pneumatic cylinder having a first fluid connection for supplying fluid to a first cylinder chamber of the double-acting pneumatic cylinder, the first cylinder chamber facing away from a piston rod of a piston in the cylinder, to extend the piston rod, and a second fluid connection for supplying fluid to a second cylinder chamber at a piston rod-side of the double-acting pneumatic cylinder, wherein the double acting pneumatic cylinder has a fluid return apparatus comprising:

a first fluid passage providing fluid communication between the first fluid connection and the first cylinder chamber;

a rapid venting valve comprising an inlet, an outlet and a vent, wherein the inlet of the rapid venting valve provides communication with the second fluid connection, wherein the outlet of the rapid venting valve provides communication with the second cylinder chamber at the piston rod-side of the double-acting pneumatic cylinder, and wherein the vent of the rapid venting valve is connected by a second fluid passage to the first fluid passage; and a non-return fitting in the second fluid passage, wherein the non-return fitting prevents fluid from flowing from the first fluid passage to the rapid venting valve and an auxiliary outlet device, wherein the first fluid passage is in fluid communication with the first cylinder chamber of the double-acting pneumatic cylinder facing away from the piston rod, and wherein the outlet of the rapid venting valve is in fluid communication with the second cylinder chamber at the piston rod-side of the double-acting pneumatic cylinder, wherein the apparatus for operating the double-acting pneumatic cylinder comprises:

a control valve with a fluid inlet and at least one fluid outlet, wherein the control valve is switchable between at least a first state and a second state, wherein in the first state the control valve connects the fluid inlet to the first fluid passage of the fluid return apparatus, and in the second state the control valve connects the fluid inlet to the inlet of the rapid venting valve of the fluid return apparatus and connects the first fluid passage of the fluid return apparatus to the at least one fluid outlet, wherein the second fluid passage directly returns the fluid from the second cylinder chamber to the first cylinder chamber, when expanding the first fluid chamber to extend the piston rod, and when the fluid pressure in the second cylinder chamber is greater than the fluid pressure in the expanding the first cylinder chamber.

10. The apparatus according to claim 9, further comprising a silencer connected to the at least one fluid outlet of the control valve.

* * * * *